United States Patent [19]

Horvat

[11] 4,391,277

[45] Jul. 5, 1983

[54] BREAST SUPPORT

[76] Inventor: Marian L. Horvat, 3811 W. Pleasant Valley Rd., Parma, Ohio 44134

[21] Appl. No.: 238,880

[22] Filed: Mar. 6, 1981

[51] Int. Cl.[3] ..... A41C 3/00

[52] U.S. Cl. ..... 128/492

[58] Field of Search ..... 128/492, 493, 460, 425, 128/442, 448, 509, 481, 477; 2/183, 195, 197, 198, 202

[56] References Cited

U.S. PATENT DOCUMENTS

| | | | |
|---|---|---|---|
| 2,420,774 | 5/1947 | Goldsholl | 128/448 |
| 2,837,746 | 6/1958 | Gundy | 2/198 |
| 3,465,754 | 9/1969 | Lockwood et al. | 128/425 |
| 3,561,442 | 2/1971 | Goswitz | 128/425 |

FOREIGN PATENT DOCUMENTS

| | | | |
|---|---|---|---|
| 604356 | 7/1948 | United Kingdom | 128/425 |
| 721642 | 1/1955 | United Kingdom | 2/200 |

*Primary Examiner*—Doris L. Troutman

*Attorney, Agent, or Firm*—John M. Romanchik, Jr.

[57] ABSTRACT

A breast support for post surgical use by an open heart surgery patient which comprises a long narrow cloth strip having a pleated cup middle portion that is adjustable to the size of breast of the user and adjustable fastening means at the ends.

4 Claims, 3 Drawing Figures

BREAST SUPPORT

BACKGROUND OF THE INVENTION

The subject invention is directed toward breast supports and more particularly to a breast support adapted to be used right after the wearer has had open heart surgery.

The preferred embodiment of the invention is especially suited for supporting the weight of a breast that tends to draw the stretched wound from open heart surgery apart, but, as will become apparent from reading the ensuing description, the invention is capable of broader application and could be used as a support in other surgical situations and for other body locations. Further, the weight of the breast pulls on the muscles causing pain but when the support is used to carry the weight, the pain is eliminated.

Many different types of breast supports have been proposed in the prior art. For example, the common breast support or brassiere has been employed by heart patients but have been found to be unsuitable as the common breast support has two cups connected by material therebetween which contacts and bears on the surgical incision. The pressure and rubbing on the wound causes great pain to the wearer. Also, the chance of infection is increased with the rubbing motion of the conventional brassiere.

The breast supports in the prior art are further unsuitable due to having peripheral straps that extend around the body of the wearer just below the breasts. This method of wearing and latching the breast supports interefers with drainage tubes that are inserted into the body of a person that had just had open heart surgery in addition to the severe pain experienced from pressure on the incision. Further, the brassieres in the prior art did not have sufficient adjustment in the straps to permit relief from pressure on the surgery wound.

The subject invention overcomes the above discussed problems and provides an improved breast support which is readily adjustable and simple to use.

BRIEF DESCRIPTION OF THE INVENTION

According to one aspect of the invention, there is provided a breast support for use by an open heart surgery patient which comprises a pleated cup that is adjustable to the size of breast of the user and a strap connected to each end of the cup that has adjustable fastening means at the ends.

A still further object is the provision of a breast support that supports the weight of the breast to eliminate the pain due to pulling of the muscles by the weight of the breast.

Thus, a primary object of the present invention is the provision of an improved breast support.

A further object is the provision of a breast support that prevents the breast of the wearer from pulling apart an incision and avoids painful pressure on the wound.

A still further object is the provision of a breast support that has means of adjustment to fit any size breast.

A still further object is the provision of a breast support that has adjustment means on the body-encircling support straps to avoid pressure on the incision of the wearer.

The above and other objects and advantages will become apparent from the following description when read in conjunction with the accompanying drawings wherein.

DESCRIPTION OF THE PREFERRED IMBODIMENTS

Figure 1:
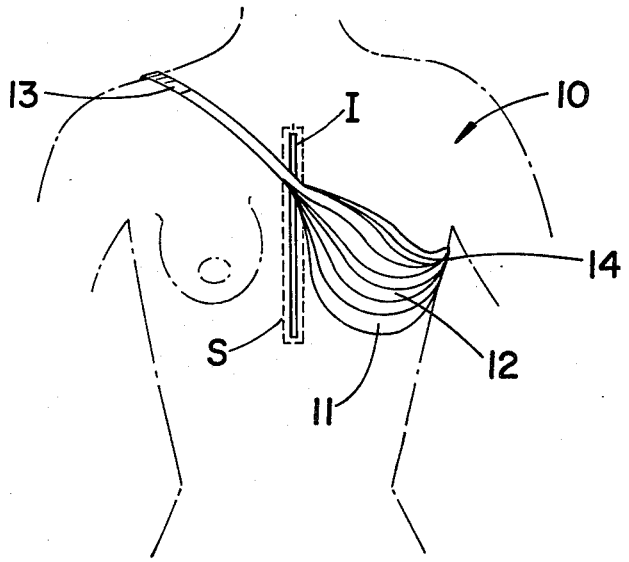
FIG. 1 is a view of the breast support of the invention showing how it is worn by the user.
Figure 2:
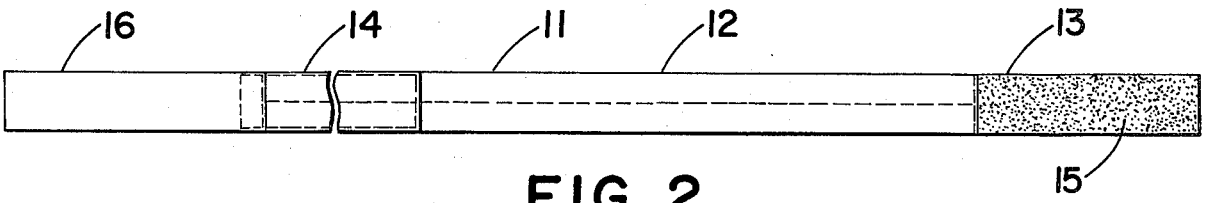
FIG. 2 is a view of the breast support showing the pleated cup in a folded position.
Figure 3:
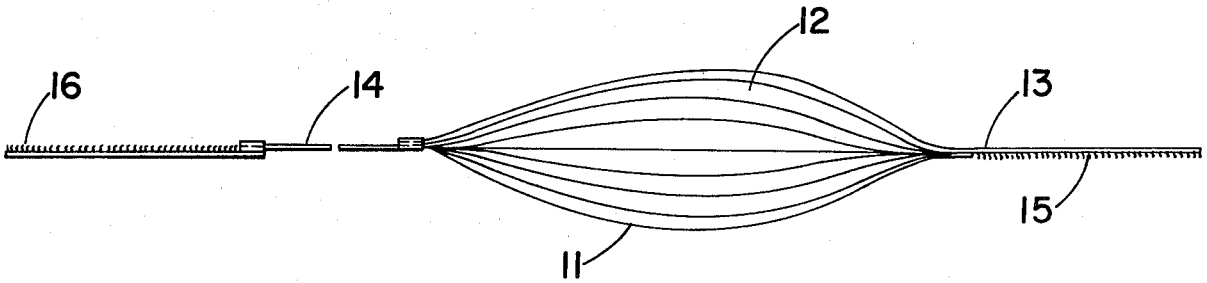
FIG. 3 is a view of the breast support showing the pleated cup in an expanded position.

Referring more particularly to the drawings wherein the showings are for the purpose of illustrating the preferred embodiments of the invention only and not for the purpose of limiting same, an embodiment of the invention as illustrated in FIGS. 1 thru 3 shows a breast support indicated generally by numberal 10. The cup 11 is preferably made of a soft cloth like paper material that is readily disposable. If desired, however, the material may be a cotton or other washable fabric for permitting further use after laundering. The cup has pleats 12 which when opened automatically adjust to the size of breast of the user. FIG. 3 shows the cup 11 with pleats 12 in an open position and FIG. 2 shows the breast support 10 with the pleats 12 of cup 11 in a folded position resulting in a long narrow strip for convenient storage and packaging. Attached to either side of cup 11 are straps 13. At the ends of straps 13 are adjusting means 14 for varying the length of straps 13 according to the size of girth of the user. The preferred type of adjusting means 14 as shown in FIGS. 2 and 3 are VELCRO-type fastener strips 14 sewn or otherwise incorporated into the ends of straps 13. Consequently, when the ends of the straps 13 overlap, the strips 14 interlock with one another to form a secure fastener to hold the breast support in a body-encircling position. One strip 14 includes looped fibrous members which cooperate with hook-like members on the mating strips to releasably secure the two ends together. Thus the amount of tightness desired can be adjusted by the amount of overlap the strips 14 are engaged. The pressure on the incision is thereby adjusted to the extent of pain the patient can bear.

The straps 13 also can be made of a disposable cloth-like paper material that has sufficient strength to avoid tearing under the tension in use. It is desirable to have a disposable breast support 10 as the wound from surgery drains during the early stages of healing and will stain the breast support. Further, it is more sanitary to use antiseptic packaged breast supports 10 rather than laundered ones and this would aid in avoiding infection.

The invention has been described in detail sufficient to enable one of ordinary skill in the art of breast supports to make and use the same. Obviously, modifications and alterations of the preferred embodiment will occur to others upon a reading and understanding of the specification. It is my intention as part of my invention insofar as they come within the scope of the appended claims.

Having thus described my invention, I claim:

1. A breast support comprising a long narrow cloth strip, said cloth strip having a middle pleated portion which is adapted for expanding open into a cup for automatically adjusting to any breast size, and means for adjusting said strip to various lengths, said middle pleated portion adapted for expanding into a cup at one end near a vertical wound in the middle of the chest of the user for supporting the breast in a first mode when the breast is positioned there from gravity and said opposite end of the pleated portion being closed, and said middle pleated portion being adapted for expanding into a cup at the other end away from said vertical chest wound for supporting the breast in a second mode when the breast is positioned there from gravity and said opposite end of said pleated portion being closed.

2. A breast support as defined in claim 1 wherein said length adjusting means is a VELCRO-type loop strip fastened to one end of said cloth strip and a VELCRO-type hook strip fastened to the other end of said cloth strip for adjusting the length of said cloth strip when placed around a body by overlapping engagement of the hook strip with the loop strip.

3. A breast support as defined in claim 1 wherein said long narrow cloth strip, when positioned around a body having a vertical surgical wound in the chest, contacts a minimal area on the wound thereby avoiding irritating the wound and causing infection.

4. A breast support as defined in claim 1 wherein said cloth strip is disposable cloth-like paper material.

* * * * *